United States Patent [19]

Crotti

[11] 3,971,521

[45] July 27, 1976

[54] APPARATUS FOR COLLECTING A CORELESS COILED THREAD PACKAGE

[76] Inventor: Renato Crotti, 71, Carso Canalgrande, Modena, Italy, 4100

[22] Filed: Mar. 11, 1974

[21] Appl. No.: 450,160

[30] Foreign Application Priority Data

Mar. 15, 1973 Italy ..... 12515/73

[52] U.S. Cl. ..... 242/47; 19/159 R; 28/21; 242/83

[51] Int. Cl.[2] ..... B65H 54/80

[58] Field of Search ..... 242/47, 82, 83; 28/21; 19/159 R, 159 A

[56] References Cited

UNITED STATES PATENTS

| | | | |
|---|---|---|---|
| 1,312,953 | 8/1919 | Cook | 19/159 R |
| 2,018,261 | 10/1935 | Holdsworth | 19/159 R |
| 2,478,960 | 8/1949 | Wilkie | 19/159 R |
| 3,233,290 | 2/1966 | Defore | 19/159 R |
| 3,327,368 | 6/1967 | Russo et al. | 28/21 |

*Primary Examiner*—Stanley Gilreath
*Attorney, Agent, or Firm*—Larson, Taylor and Hinds

[57] ABSTRACT

An apparatus for collecting a coreless coiled thread package having a central hollow bore, comprises a thread collecting or receiving disc which presents a central through bore, and a vertical guide column which engages the said bore of the receiving disc, in such a manner that the said disc is displaceable upwardly and downwardly along the said column. The guide column is constructed as a tubular hollow structure, and inside the said hollow structure there are arranged the means for elastically urging upwardly a carriage which is vertically displaceable along the column and carries the said receiving disc. The receiving disc is fitted in a removable, but nonrotatable, manner on the carriage, which, in turn, is not rotatable about the guide column.

3 Claims, 5 Drawing Figures

APPARATUS FOR COLLECTING A CORELESS COILED THREAD PACKAGE

BACKGROUND OF THE INVENTION

1. Field of the Invention

The present invention relates to the coiling of a substantially continuous length of textile material, hereinafter generically referred to as thread, such as for example yarn, sliver and the like, made of wool, cotton, synthetic fibers or any other suitable material. More particularly, this invention relates to an apparatus for collecting a coreless coiled thread package having a central hollow bore, said package being produced by a suitable coiler device of any type known in the art.

2. Description of the Prior Art

In the prior art there are known apparatuses for collecting a coiled thread package produced by any suitable thread depositing device, or coiler head. An apparatus of this kind is for example illustrated in the U.S. Pat. No. 2,598,738 (WILKIE) where the collecting or receiving plate or disc, which must be constantly elastically urged upwardly towards the coiler head, is sustained during its vertical movement inside the collecting can (upwardly and downwardly) by at least three cords anchored at one end at three angularly equispaced points of the periphery of said receiving disc (or suitable supporting means for said disc), and the said cords, after having being passed over corresponding pulleys arranged in correspondence of the outer periphery of the top of the can, are fastened at their other end to spring urged devices (such as grooved drums) which tend to pull the said cords, thus maintaining the receiving disc elastically urged upwardly.

According to French Pat. No. 2,035,240 (DAIWA) the receiving or collecting disc is supported by a plate which is elastically urged upwardly by means of a helical spring having substantially a diameter which is equal to the inner diameter of the collecting can.

The disadvantages of the above mentioned devices can be briefly summarized as follows: firstly, both devices need an outer structure, such as a can, for the provision thereonto of the means for elastically urging upwardly the receiving disc (U.S. Pat. No. 2,598,738), or for guiding and protecting said means and the receiving disc during their vertical displacement (French Pat. No. 2,035,240); secondly, during the coiling and deposition of the thread onto the receiving disc by the depositing or coiler head, it may happen that, due to some malfunctioning of the said coiler head, the formation of the layers is disturbed by the possibility that some lengths of thread occupy the central section of the thread package being formed, which should be coreless and present precisely a hollow central bore, for the insertion of suitable devices such as dyeing candles, and which should be absolutely free and unobstructed; eventually, and particularly in the case of the device disclosed in the U.S. Pat. No. 2,598,738, where the elastic support of the receiving disc is obtained by means of several separate devices acting on the periphery of the disc, any malfunctioning, such as a jamming or locking of one these devices, will produce the tilting of the receiving disc, and therefore spoil the formation of the package.

SUMMARY OF THE INVENTION

According to the invention, an apparatus for collecting a coreless coiled thread package having a central hollow bore is provided, which comprises a thread receiving or collecting disc presenting a central through bore having a diameter which is slightly lesser than the diameter of the bore of the package, and which disc is vertically displaceable along a vertical guide column which engages the said through bore in the said receiving disc. The receiving disc is elastically supported, during its vertical displacement, by a carriage sliding along the said guide column, onto which carriage the receiving disc is fitted in a removable manner. The guide column is constructed as a tubular hollow structure, and it advantageously contains at its interior the means for elastically urging upwardly the carriage and the disc supported thereby.

It appears evident, therefore, that the inconveniences mentioned as regards the prior art are overcome by the collecting apparatus according to the present invention, which permits the collection of coiled yarn packages of great size and height, if desired also without the need of collecting cans; in which the presence of the coreless central hollow bore in the package is ensured positively by the presence of the guide column, and according to which the supporting means for the receiving disc consist of a single element (the carriage) arranged centrally with respect to the package, which avoids the possibility of tilting or undesired inclination of the said receiving disc. Further, the presence of the mentioned column avoids the possibility, during the tilting which may take place at the moment of taking away the completed yarn package from beneath the coiler or depositing head, that the formed package may be spoiled by the displacement and consequent intermingling of the layers of thread towards the hollow center bore of the package itself.

These and other features of the invention will be clearly understood from the following description of some preferred embodiments thereof with reference to the accompanying drawings, and the novel features will be particularly pointed out in the appended claims.

DESCRIPTION OF A PREFERRED EMBODIMENT

Figure 2:
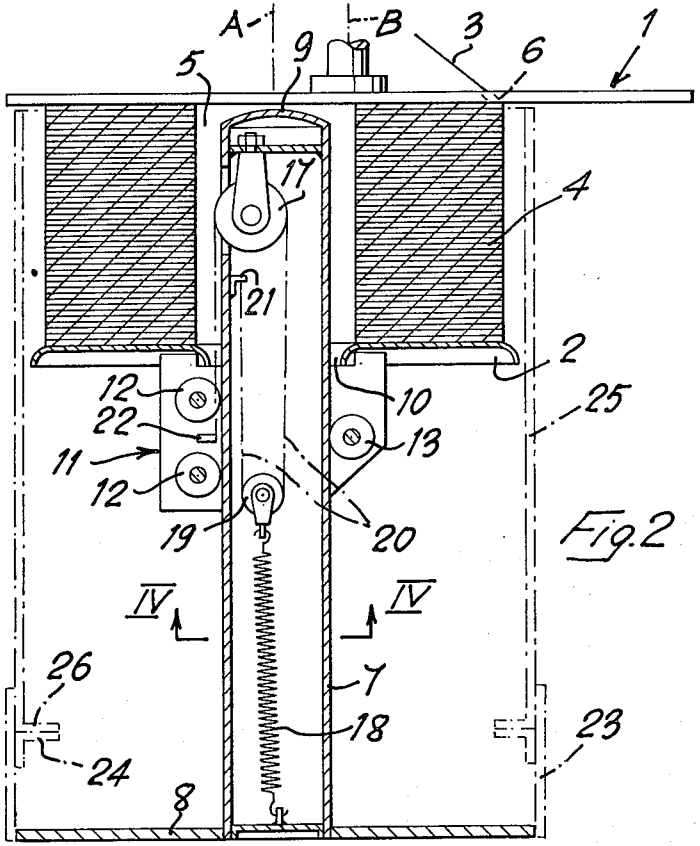
FIG. 2 is a vertical section, with some parts in cross-section, of the apparatus according to the invention, during the collection of a coreless coiled thread package.
Figure 1:
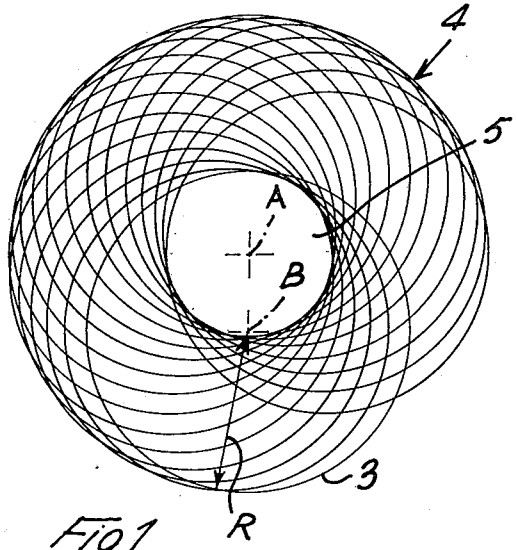
FIG. 1 shows diagrammatically a pattern of deposition of the thread as effected onto the receiving or collecting disc of the apparatus according to the invention.

With particular reference to FIGS. 1 and 2, a depositing disc 1 deposits onto a receiving disc 2 the thread 3 so as to form a coreless coiled thread package 4 having a central hollow bore 5. The coreless coiled thread package 4 shown in FIG. 1 is constructed of a continuous length of thread disposed in substantially annular layers forming a coil, each layer being composed of a series of loops which progress along the annular layer of the coil, and in the example as shown, the diameter of each loop is greater than the radius of the package. Of course, the said diameter of the loop can be smaller than the said radius of the package, as it is known from the prior art. In any case, the radius R of each loop is always selected in such a manner that, in the course of the formation of the package 4, there will be also formed a hollow central bore 5.

An apparatus for the formation of such a coiled thread package comprises a thread depositing disc 1 provided with a through bore 6 for the passage of the thread to be deposited, from suitable supply means (not shown) onto the thread receiving plate or disc 2. The thread depositing disc rotates about an axis B which is arranged eccentrically with respect to the axis A of the coiled yarn package, which coincides with the axis of the receiving disc 2.

At the same time, a relative rotational movement is provided between the axis B of rotation of the depositing disc 1 and the axis A of the thread package, which, as above mentioned, coincides with the axis of the receiving disc 2. This relative rotational movement can be obtained in two ways. According to a first mode of operation, the axis B of the thread depositing disc is fixed as the disc 1 rotates about axis B and the thread is therefore deposited through the bore 6 in circular rings. Since however also the receiving disc 2 rotates around its axis A, the thread will be deposited on said receiving disc in loops which progress along an annular path. According to a second mode of operation, the receiving disc 2 does not rotate around its axis A, while the depositing disc 1, besides rotating about its own axis B, revolves also about the eccentrically arranged fixed axis A, which coincides with the center of the package 4 being formed.

Beneath the depositing disc 1 there is arranged a guide column 7 for the receiving disc 2. The said guide column 7 is fixed onto a pedestal 8 and extends upwardly almost to reach the lower side of the depositing disc 1, where it terminates with a rounded head portion 9. The receiving disc 2 presents a central through bore 10 and it is fitted onto said guide column 7 in a manner as to be capable to move upwardly and downwardly along said column. For this purpose, the receiving disc 2 is carried by a supporting carriage 11 arranged below same, which is movable in the vertical direction along the column 7 on suitable rollers 12, 13, but it cannot rotate about said column 7. The receiving disc 2 is removably fitted, in a non rotatable manner, onto the said supporting carraige. In the embodiment as shown, the central through bore 10 of the receiving disc 2 presents a downwardly bent edge which fits into the corresponding recesses obtained in the top portion of the supporting carriage 11.

The guide column 7 is constructed as a tubular hollow column. In the embodiment shown in FIGS. 2, 3 and 4, the said guide column 7 presents a trapezoidal section, and the supporting carriage 11 presents two pairs of superposed rollers 12 which are capable of rolling along the side of the column 7 corresponding to the greater base of the trapezium, while an opposed roller 13 is arranged so as to roll on the opposite side of the column corresponding to the smaller base of the trapezium (see particularly FIG. 4). In this manner, rotation of the carriage 11, and of the depositing disc 2 fitted thereonto, around the guide column 7 are avoided. The central through bore 10 in the receiving disc 2 can be circular, or present a trapezoidal shape similar to that of the section of column 7.

In the vicinity of the upper end of the column 7, there is arranged a pulley 17. In the vicinity of the bottom of column 7 there is arranged a coil spring 18 which is anchored at one end at the said bottom, while at the other end it carries a pulley 19. A cord 20 is further provided, which is anchored to column 7 at a suitable anchoring point 21, and is hence passed onto pulley 19 and 17, out of column 7 through a suitable slot provided in the vicinity of pulley 17, to an anchoring point 22 provided on the supporting carriage 11.

Figure 3:
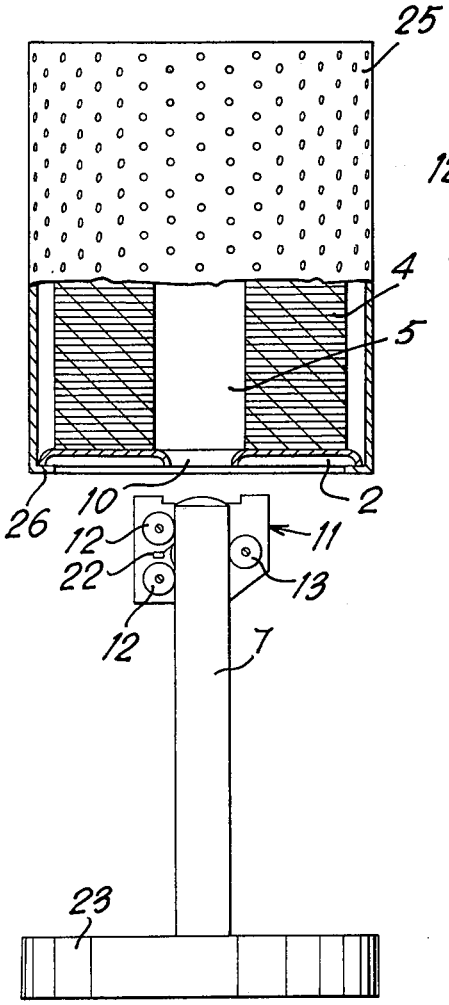
FIG. 3 is a side elevation view, with some parts in section, of the apparatus according to the invention, modified so as to collect the package inside a can, and during the take-off operation of the completed can.
Figure 4:
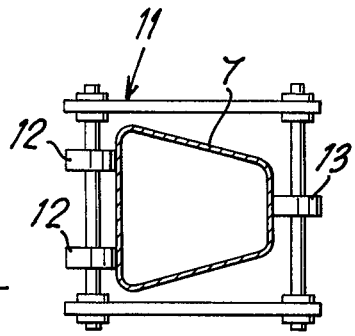
FIG. 4 is a section along line IV—IV of FIG. 2.

As can be clearly seen from FIG. 3, the apparatus is arranged in such a manner that, at the beginning of the formation of the coiled thread package, the supporting carriage 11 carrying the empty receiving disc 2 will have its upper portion substantially at the same height as the rounded top portion 9 of column 7. Therefore, the empty receiving disc will present its upper receiving surface at a level which is slightly higher than the said top 9 of the column, so as to bear against the opposed face of the depositing disc 1, thus permitting a regular starting in the production of the thread package.

Gradually, as the formation of the package proceeds, the receiving disc 2 will be lowered, due to the formation of the package itself, along the column 7, against the action of the spring 18. It appears evident in this respect, the counter-action of spring 18 will gradually increase as the disc 2 goes further down, but this increase will be compensated by the increased weight of the package 4 being formed on and supported by the receiving disc 2.

It will be noted that, in this manner, the thread package will be produced while the guide column 7 will gradually penetrate into the through bore of disc 2 and into the coreless central bore of the package itself being formed.

After the completion of the thread package 4, i.e. after the receiving or collecting disc 2 has reached its lowermost position, said disc 2 can be locked by any suitable known devices in said lowermost position, and the collecting apparatus, i.e. the column 7, pedestal 8 and disc 2 (with package laid thereonto) can be moved away from the depositing disc 1. Thereafter, the completed yarn package can be extracted by freeing the locking device of the receiving disc, and by lifting said receiving disc, so as to disengage the column 7 (see particularly FIG. 3). At this point, if desired, another suitable column-like element (not shown) can be provided, to engage again the central bore 5 of the package 4.

Although the central guide column 7 ensures the required stability of the package 4, in certain cases it is convenient to provide a cylindrical outer mantle protection so as to obtain a can-like container of the type commonly used.

Such an arrangement is illustrated by dash-and-dot lines in FIG. 2, and in full lines in FIG. 3. In this case, a socket member 23 is provided on the pedestal 8 of column 7, said socket member 23 being provided with an inwardly directed flange 24, upon which there rests a corresponding inwardly directed flange 26 provided at the bottom end of a cylindrical mantle 25, which is perforated as known in the art.

The inwardly directed flange 26 of mantle 25 serves also as a resting base for the outer edge of the receiving disc 2, whenever same reaches its lowermost position, so that the completed thread package 4 can be lifted, as clearly shown in FIG. 3, in a can-like container having as a cylindrical side wall the mantle 25, and as the base the receiving disc 2.

MODIFICATIONS

Figure 5:
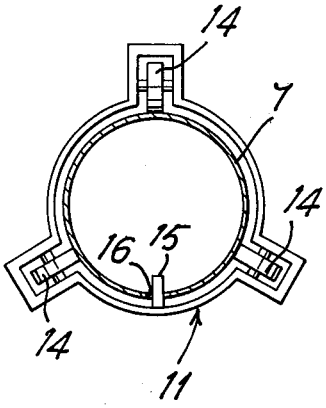
FIG. 5 is a section similar to that of FIG. 4, showing a modification in the construction of the guide column of the apparatus according to the invention.

In FIG. 5 there is illustrated a modification relating to the shape of the guide column 7, which, as it can be clearly seen, presents a perfectly circular section. According to this embodiment, the carriage 11 presents a correspondingly shaped circular section, and there are provided, along its periphery and at equispaced angles, the rollers 14 for the movement of the carriage 11 along the column 7. Also in this case, there is provided at least a pair of superposed rollers, to avoid inclinations of the disc 2. The carriage 11 is provided with an inwardly directed pin element 15, which engages a corresponding slot 16 obtained longitudinally along the whole height of the column 7, in order to avoid rotation of the carriage 11 (and of the disc 2 carried thereby) about the column 7.

In the above described embodiments, it has always been considered an apparatus in which the depositing disc 1 is of the type which, besides rotating about its own axis B, also revolves about the axis A of the package 4, i.e. an apparatus of the type in which the receiving disc 2 does not rotate about its axis A, but moves only in the vertical direction.

In those apparatuses, as above mentioned, in which the receiving disc 2 must rotate about its axis A, suitable known means will be provided for imparting such rotation to the column 7 (or pedestal 8), and consequently to the disc 2 which is vertically displaceable but not rotatable on said column. These means are not illustrated, since they are well known in the art.

Also, it must be noted that the above invention has been particularly described in connection with an apparatus for the collection of the thread, while the device for the deposition of the thread (in the present case the depositing disc 1) has been merely illustrated by way of non limiting example. Other suitable thread depositing devices may be therefore used, of any type already known in the art, or which may be in the future realized.

It is believed that the invention will have been clearly understood from the foregoing detailed description of some preferred embodiments. Changes in the detail of construction may be resorted to without departing from the spirit of the invention, and it is accordingly intended that no limitation be implied and that the hereto annexed claims be given the broadest interpretation to which the employed language fairly admits.

I claim:

1. An apparatus for collecting a coreless coiled thread package having a central hollow bore, said apparatus comprising:

a thread collecting or receiving disc, having means for defining a central through bore;

a vertical guide column passing through said bore of the said receiving disc, so as to permit vertical displacement of the said receiving disc upwardly and downwardly along said guide column, said guide column being constructed as a tubular hollow column structure, supporting means for supporting said receiving disc during its vertical displacement along the guide column, said supporting means comprising a carriage mounted on the column to move therealong in the vertical direction, said receiving disc being fitted in a removable but nonrotatable manner onto the said carriage, and further means being arranged inside of the hollow column structure for elastically urging said supporting means upwardly, towards the top of the column, and said guide column having a section which is noncircular, presenting at least two substantially straight sides, and the carriage being mounted on rollers, at least two of said rollers being arranged so as to roll along the flat surfaces of the column corresponding to said straight sides.

2. An apparatus according to claim 1, in which the through bore of the receiving disc has a section substantially equal and slightly larger than the section of the column.

3. An apparatus for collecting a coreless coiled thread package having a central hollow bore, said apparatus comprising:

a thread collecting or receiving disc, having means for defining a central through bore;

a vertical guide column passing through said bore of the said receiving disc, so as to permit vertical displacement of the said receiving disc upwardly and downwardly along said guide column, said guide column being constructed as a tubular hollow column structure, supporting means for supporting said receiving disc during its vertical displacement along the guide column, said supporting means comprising a carriage mounted on the column to move therealong in the vertical direction, said receiving disc being fitted in a removable but nonrotatable manner onto the said carriage, and further means being arranged inside of the hollow column structure for elastically urging said supporting means upwardly, towards the top of the column, and in which inside the hollow column structure there is arranged, in the vicinity of top of the same, a pulley, another pulley being arranged at the free end of a spring, the other end of which spring is anchored in the vicinity of the bottom of the column structure, a cord or similar flexible element being provided which is anchored at one end at a fixed point inside said column structure, while at the other end it is anchored at a point provided on the supporting means of the receiving disc, said cord or flexible element being suitably passed around said pulleys, whereby a downward displacement of the supporting means promotes a tensioning of the spring.

* * * * *